US008739934B2

(12) United States Patent
Iskrenovic

(10) Patent No.: US 8,739,934 B2
(45) Date of Patent: Jun. 3, 2014

(54) USER-POWERED WATER HEATER

(75) Inventor: Zoran Iskrenovic, Nis (RS)

(73) Assignee: Seven International Group, Inc., Los Angeles, CA (US)

( * ) Notice: Subject to any disclaimer, the term of this patent is extended or adjusted under 35 U.S.C. 154(b) by 668 days.

(21) Appl. No.: 13/086,111

(22) Filed: Apr. 13, 2011

(65) Prior Publication Data

US 2011/0253068 A1 Oct. 20, 2011

Related U.S. Application Data

(60) Provisional application No. 61/324,629, filed on Apr. 15, 2010.

(51) Int. Cl.
*F03G 5/00* (2006.01)

(52) U.S. Cl.
USPC ..... 185/15

(58) Field of Classification Search
CPC ..... F03G 1/00; F03G 5/06; F03G 2730/05; F03G 5/00
USPC ..... 384/15, 15.5, 3, 9, 10; 122/4 R; 219/628; 392/441–464, 485–494
See application file for complete search history.

(56) References Cited

U.S. PATENT DOCUMENTS

| | | | | |
|---|---|---|---|---|
| 3,809,856 | A | 5/1974 | Willis | |
| 7,893,551 | B2 * | 2/2011 | Dai | 290/1 C |
| 2006/0191901 | A1 * | 8/2006 | Taylor et al. | 219/521 |
| 2007/0285053 | A1 * | 12/2007 | Noguchi et al. | 320/114 |

FOREIGN PATENT DOCUMENTS

CN 101033855 A * 9/2007

* cited by examiner

*Primary Examiner* — Phillip A Johnson
(74) *Attorney, Agent, or Firm* — Fish & Tsang LLP

(57) ABSTRACT

Water heaters are described that are user-powered, such that external sources of power are unnecessary. The water heaters include a heating device and a generator coupled to a crank such that power is generated as the crank is rotated, which can be used to power the heating device.

10 Claims, 3 Drawing Sheets

USER-POWERED WATER HEATER

This application claims the benefit of priority to U.S. provisional application Ser. No. 61/324,629 filed on Apr. 15, 2010. This and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

FIELD OF THE INVENTION

The field of the invention is water heaters.

BACKGROUND

All water heaters known to Applicant require an external source of power, such as a line voltage, natural gas source, or a battery that must be recharged. Such water heaters are disadvantageous as they are not suitable for extended uses away from these respective external sources of power, and cannot, for example, be powered by a user.

U.S. Pat. No. 3,809,856 to Wills discusses an exemplary water heater that utilizes a pair of electrodes through which current can pass to heat water flowing between the electrodes. To change the temperature of the outflowing water, the distance between the electrodes is changed. Although this change in distance can be automatic, Wills contemplates that a handcrank could be used to manually vary the water's temperature. However, the Wills water heater is powered from an external source of gas or electricity, and thereby suffers from the same disadvantages discussed above.

It is also known to utilize a hand crank to generate a limited amount of power, such as for a radio or flashlight. However, Applicant is unaware of any user-powered devices that impart heat to water.

Thus, there is still a need for user-powered water heater.

SUMMARY OF THE INVENTION

The inventive subject matter provides apparatus, systems and methods in which a water heater can be user-powered. As used herein, the term "user-powered" means that the energy is created by a user, whether by the user's hand, foot, or otherwise.

In preferred embodiments, the water heater can include a crank that is coupled to a generator by way of one or more gears. As the crank is rotated about its axis, one or more gears can be rotated that in turn rotate a shaft of the generator to thereby generate electricity. The electricity can then be stored and/or used to power a heating device configured to heat water that passes by the heating device. However, other commercially suitable mechanisms for rotating the generator's shaft are also contemplated.

Unless the context dictates the contrary, all ranges set forth herein should be interpreted as being inclusive of their endpoints and open-ended ranges should be interpreted to include only commercially practical values. Similarly, all lists of values should be considered as inclusive of intermediate values unless the context indicates the contrary.

As used herein, the term "heating device" means any commercially suitable device for heating water including, for example, coils and friction elements.

Various objects, features, aspects and advantages of the inventive subject matter will become more apparent from the following detailed description of preferred embodiments, along with the accompanying drawing figures in which like numerals represent like components.

DETAILED DESCRIPTION

One should appreciate that the disclosed techniques provide many advantageous technical effects including the ability to heat water using energy generated by a user, rather than external sources of energy such as natural gas or a line voltage.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

Figure 1:
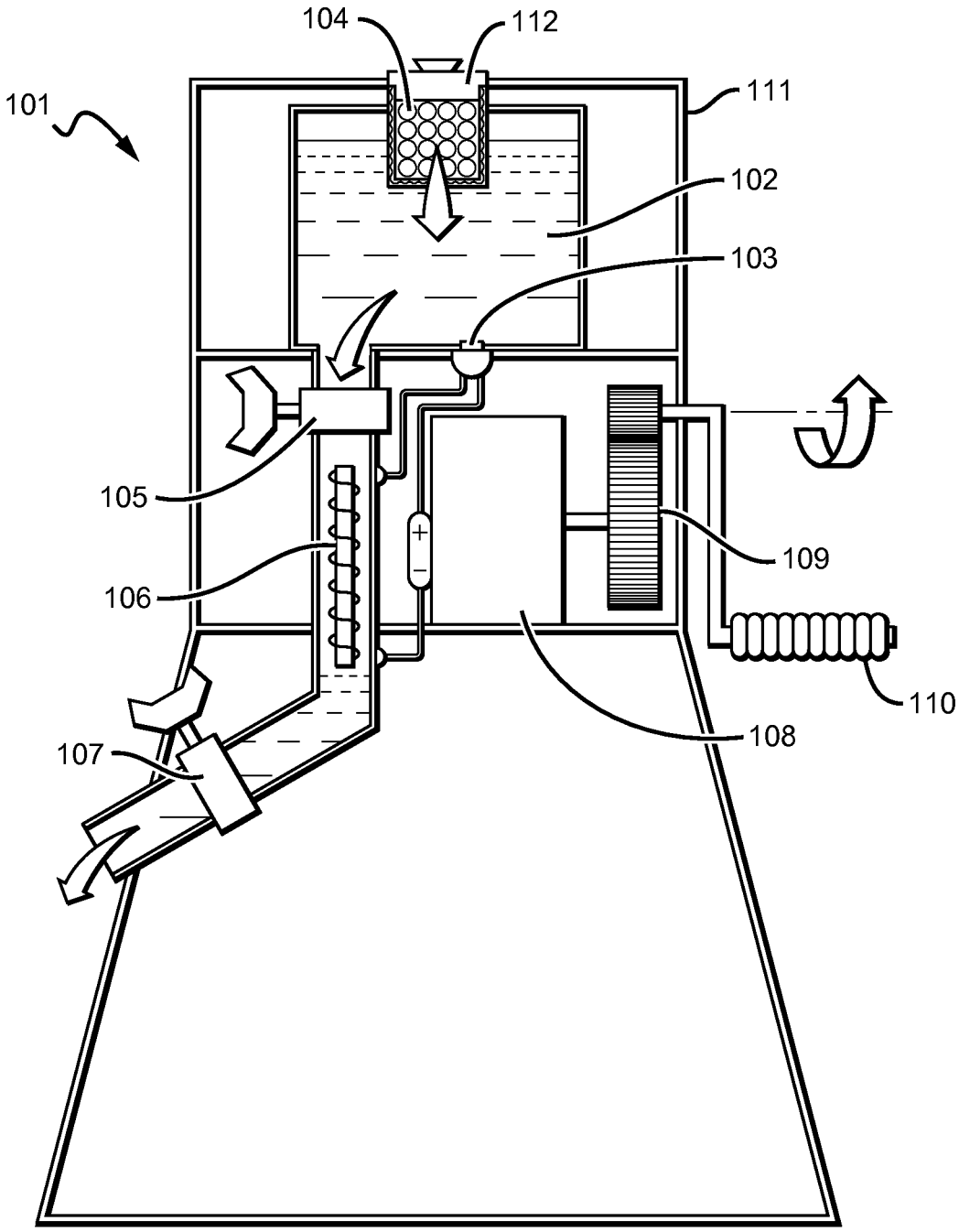
FIG. 1 is a schematic of an embodiment of a user-powered water heater.

In FIG. 1, a user-powered water heater 101 can include a reservoir 102 that is fluidly coupled to a heating device 106. It is alternatively contemplated that the water heater 101 can lack a reservoir 102, and instead have water poured into the water heater 101 when heating of the water is desired.

The water heater 101 can have a housing 111 that can enclose the reservoir 102 and the heating device 106. The housing 111 can have any commercially suitable size and dimension, and in preferred embodiments, the housing 111 has an outwardly tapered bottom such that a surface area of the base of the water heater 101 is increased to assist in keeping the water heater 101 in an upright position. It is contemplated that the water heater 101 can be sized and dimensioned to be portable and carried by a person, and preferably, has a height of no more than 4 feet (1.22 m).

A filter 104 can be disposed near or within an inlet 112 to the reservoir 102 to filter incoming fluid before it enters the reservoir 102. This is advantageous as the filter 104 can reduce the particulates in the water and thereby reduce the build-up of calcium and other minerals within the water heater 101. In some embodiments, the inlet 112 can have a conical shape to facilitate pouring of the water through the inlet 112.

The water heater 101 can include a crank 110, which can be coupled to a gear 109 that is in turn coupled to a shaft of a generator 108. In this manner, as the crank 110 is rotated, the generator shaft is also rotated, which generates electricity. At least a portion of the electricity can then be used to power the heating device 106. Alternatively, a battery or other storage device could be used to store electricity produced by the generator 108 for future use. Although a crank 110 is shown, it is contemplated that any device could be used or coupled to the crank 110 that will effect a rotation of the generator shaft including, for example, a foot or hand pedal. It is further contemplated that a crank 110 or other commercially suitable device can be disposed on opposite sides of the water heater 101 to facilitate rotation of the shaft of the generator 108.

A valve 107 can be positioned downstream of the heating device 106 to regulate a flow of water exiting the water heater 101. Optionally, a valve 105 can be disposed between the reservoir 102 and the heating device 106 to regulate a flow of water to the heating device 106.

The water heater 101 can also include one or more sensors 103 that are configured to detect the presence or flow of water, the temperature of the water, and so forth. For example, sensor 103 could be used detect the presence of water in the reservoir 102, such that if little or no water is present, the heating device can be prevented from activating and thereby lengthen the life of the heating device 106. In this instance, and where other upper limits are not expressly stated, the reader should infer a reasonable upper limit. In this instance, for example, a commercially reasonable upper limit is about ten.

Figure 2:
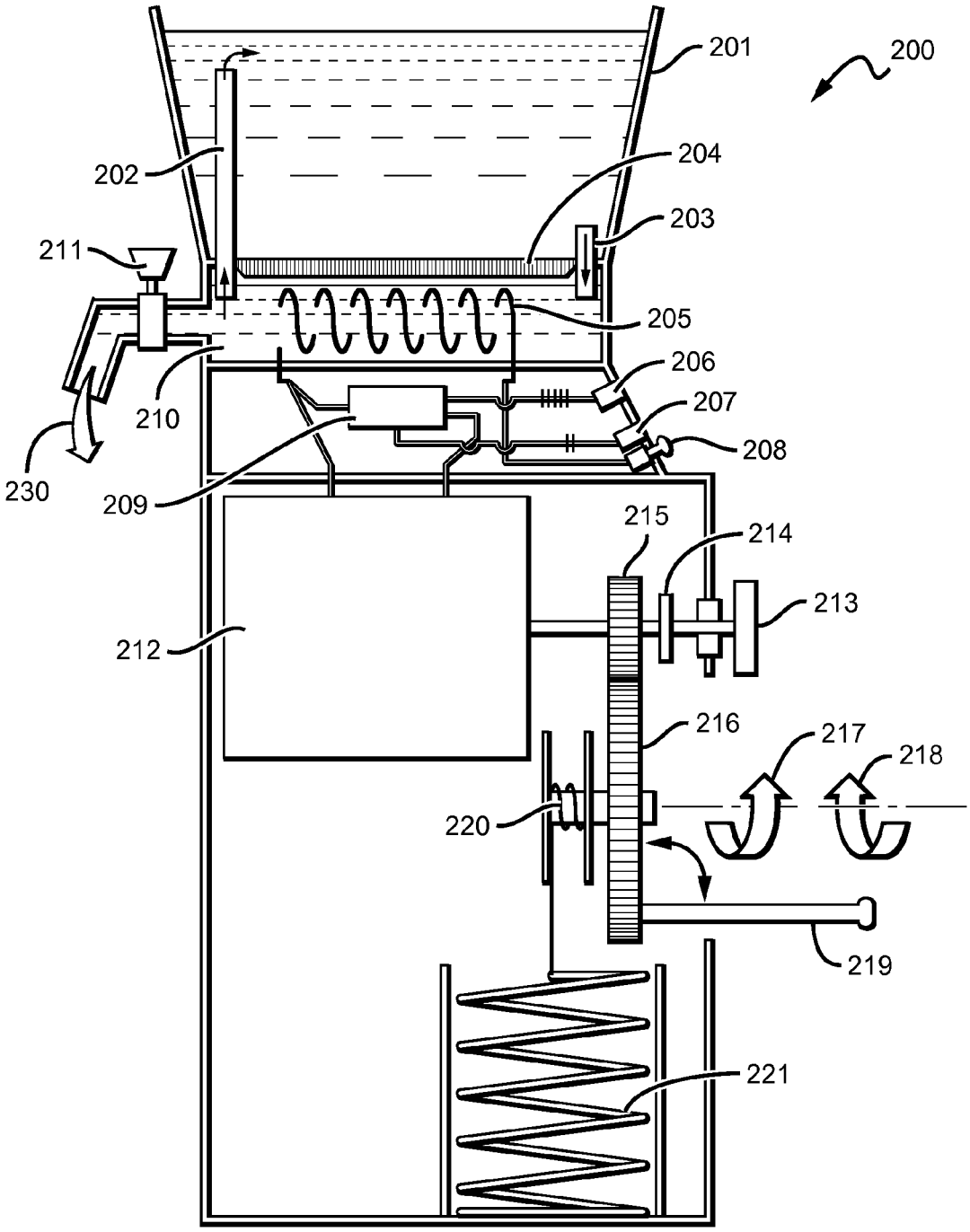
FIG. 2 is a schematic of another embodiment of a user-powered water heater.

FIG. 2 illustrates an alternate embodiment of a water heater 200 that can include a reservoir 201, into which water can be poured. The water heater 200 can also include a crank 219 that is coupled to at least one gear 216. Gear 216 can be connected to another gear 215 that can be coupled to the shaft of generator 212. In this manner, the addition of gear 215 allows the generator shaft to rotate more frequently than the crank 219 is rotated. However, one skilled in the art will understand that the specific gearing of the water heater 200 will depend upon the generator used, and the desired rotation speed of the crank 219.

Gear 216 can be coupled to a spring 221 by a coupling 220 such that the kinetic energy from the rotation of gear 216 in direction 217, for example, can be stored as potential energy in the spring 221. A lock or other mechanism 214 can be engaged using actuator 213 to thereby prevent rotate of the gears 215 and 216, and advantageously allow the potential energy of the spring 221 to be stored until needed. Once the gears 215 and 216 are allowed to rotate, the spring 221 can begin to release its potential energy and thereby rotate gear 216 and crank 219 in direction 218, which will rotate gear 215 and the generator shaft to generate electricity.

The water heater 200 can include a battery 209 that can store at least some of the electricity by the generator 212. The water heater 200 can further include a switch 208 that can regulate the current flowing through the heating device 205, and thereby regulate a temperature of the water exiting the water heater 200.

The heating device 205 can be electrically coupled to the generator 212 such that at least a portion of the electricity generated can be used to heat water flowing through or past the heating device 205 in compartment 210. A valve 211 can be disposed between an outlet 230 and the heating device 205 to regulate a flow of water from the water heater 200. It is contemplated that the water heater 200 can have an electrical outlet 207 into which an external heating device (shown in FIG. 3) or other electrical device could be plugged. In this manner, power generated from the generator 212 can be used to power other devices.

Piping 202 and 203 can be disposed to fluidly coupled the reservoir 201 and compartment 210 and allow water to flow into, and out from, the reservoir 201, respectively. The water heater 200 can further include a filter 204.

Figure 3:
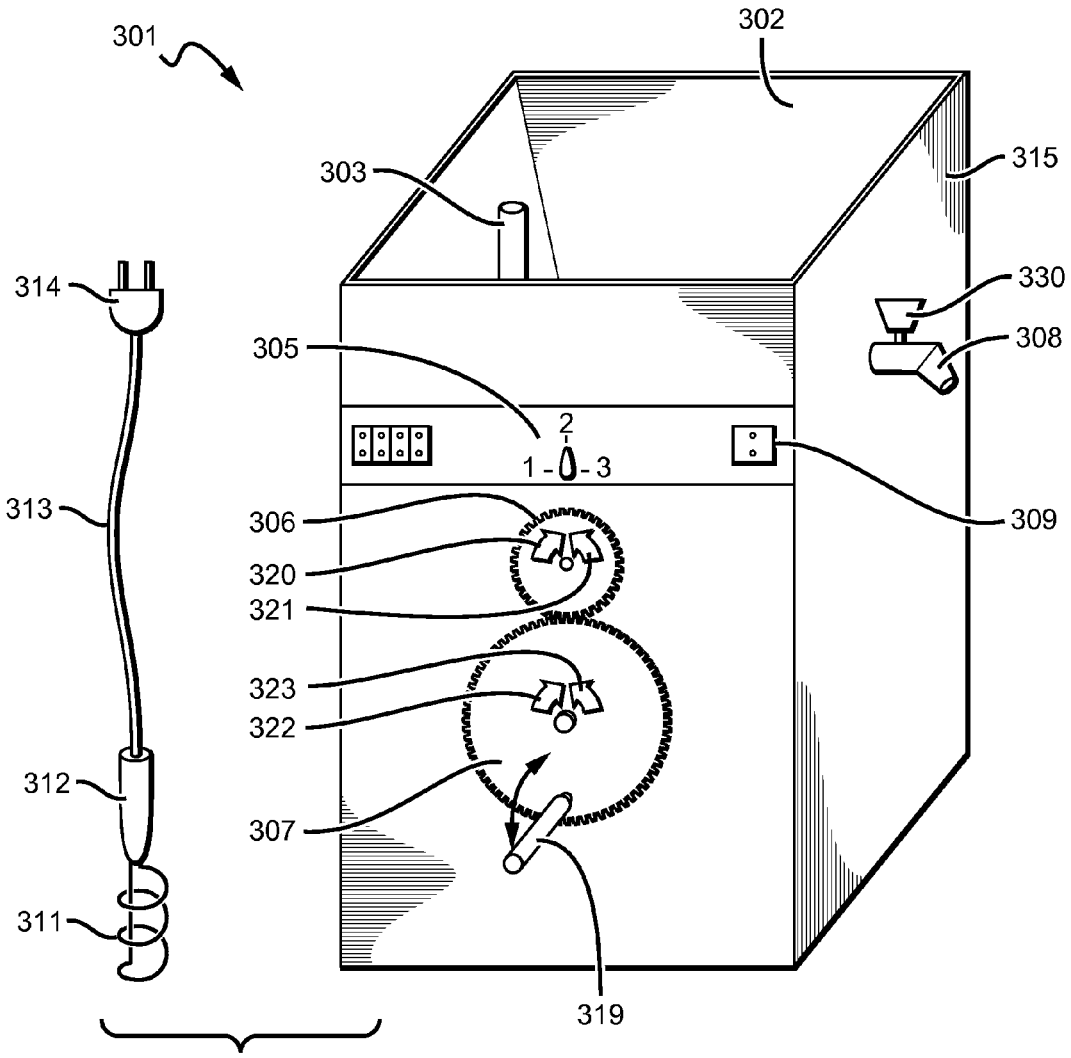
FIG. 3 is a perspective view of yet another embodiment of a user-powered water heater.

FIG. 3 illustrates another embodiment of a water heater 301 having a rectangular-shaped housing 315, although it is contemplated that the housing 315 could have any commercially suitable size and dimension. The water heater 301 can include a water reservoir 302 and piping 303.

To power the water heater 301, a crank 319 can be coupled to a generator (not shown) by one or more gears 306 and 307, such that rotation of gear 307 in direction 322 will rotate gear 306 in direction 321, and rotation of gear 307 in direction 323 will rotate gear 306 in direction 320. Preferably, rotation of gear 307 in one direction will cause the generator to generate power, and rotation of gear 307 in an opposite direction can be used to store kinetic energy in a spring or the device.

The water heater 301 can include a switch 305 that can regulate the current flowing through a heating device (not shown), and thereby regulate a temperature of the water exiting through fluid outlet 308. It is contemplated that a valve 330 could be fluidly coupled to outlet 308 to regulate a flow of water through the outlet 308.

In some contemplated embodiments, the water heater 301 can have an electrical outlet 309 into which an external heating device 313 or other device could be plugged. Thus, for example, a plug 314 of the external heating device 313 can be inserted into the outlet 309, and allow current to flow through the external heating device 313 to heat coils 311. The coils 311 can then be used to remotely heat water, such as in a canteen, as well as heat other items. The external heating device 313 can include electronics 312 that can be configured to regulate a flow of current to the coils 311, for example.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A user-powered water heater, comprising:

a crank;

a generator coupled to the crank, and configured to generate power as the crank is rotated; and a heating device configured to receive at least a portion of the power.

2. The water heater of claim 1, further comprising a sensor.

3. The water heater of claim 2, wherein the sensor is configured to detect a fluid flow within the water heater.

4. The water heater of claim 2, wherein the sensor is configured to measure a volume of water in the water heater.

5. The water heater of claim 1, wherein the crank is coupled to a pedal.

6. The water heater of claim 1, further comprising a reservoir configured to hold at least 3 liters of water.

7. The water heater of claim 6, wherein the heating device is configured to receive and heat at least a portion of the water from the reservoir.

8. The water heater of claim 1, further comprising a valve fluidly coupled downstream of the water heater, and configured to regulate a flow of water from the water heater.

9. The water heater of claim 1, further comprising an elastic device coupled to the crank, and wherein the elastic device is configured to store a kinetic energy from a rotation of the crank.

10. The water heater of claim 1, further comprising an electrical outlet configured to receive a power plug of an external device.

* * * * *